United States Patent [19]

Reith

[11] Patent Number: 4,799,621

[45] Date of Patent: Jan. 24, 1989

[54] METHOD AND APPARATUS FOR SHIELDING CARGOES FROM CONDENSATE

[76] Inventor: Johann-Stephan Reith, Palmaille 118, D-2000 Hamburg 50, Fed. Rep. of Germany

[21] Appl. No.: 45,699

[22] Filed: Apr. 29, 1987

Related U.S. Application Data

[63] Continuation of Ser. No. 610,326, May 15, 1984, abandoned.

[30] Foreign Application Priority Data

May 16, 1983 [DE] Fed. Rep. of Germany ..... 3317776

[51] Int. Cl.[4] ..... G05D 23/00

[52] U.S. Cl. ..... 237/2 A; 236/44 C

[58] Field of Search ..... 237/69, 43; 236/44 C; 165/41, 43, 21

[56] References Cited

U.S. PATENT DOCUMENTS 1,404,901 1/1922 Schreiber ..... 237/69

2,118,884 5/1938 Fuchs ..... 237/12.3 B X

FOREIGN PATENT DOCUMENTS 122239 10/1978 Japan ..... 236/44 C

*Primary Examiner*—Henry A. Bennet

*Attorney, Agent, or Firm*—Peter K. Kontler

[57] ABSTRACT

Bulk cargo which is sensitive to condensate is confined in the cargo area of a seagoing or other vessel in such a way that it comes into direct contact with the walls surrounding the cargo area and is also in contact with moisture-laden air filling the remainder of such area. In order to prevent condensation of moisture on the walls surrounding the cargo area, the temperature of the walls as well as the temperature of air in the cargo area is maintained at a value such that the moisture cannot condense on the walls. This can be achieved by heating the confined air and/or the walls and/or by reducing the moisture content of confined air and/or by a combination of such undertakings.

45 Claims, 1 Drawing Sheet

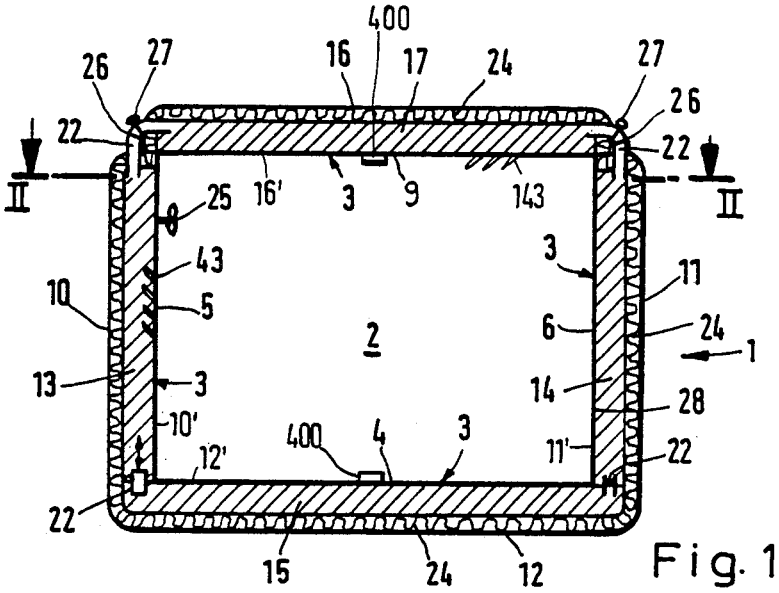
Fig. 1
Fig. 2
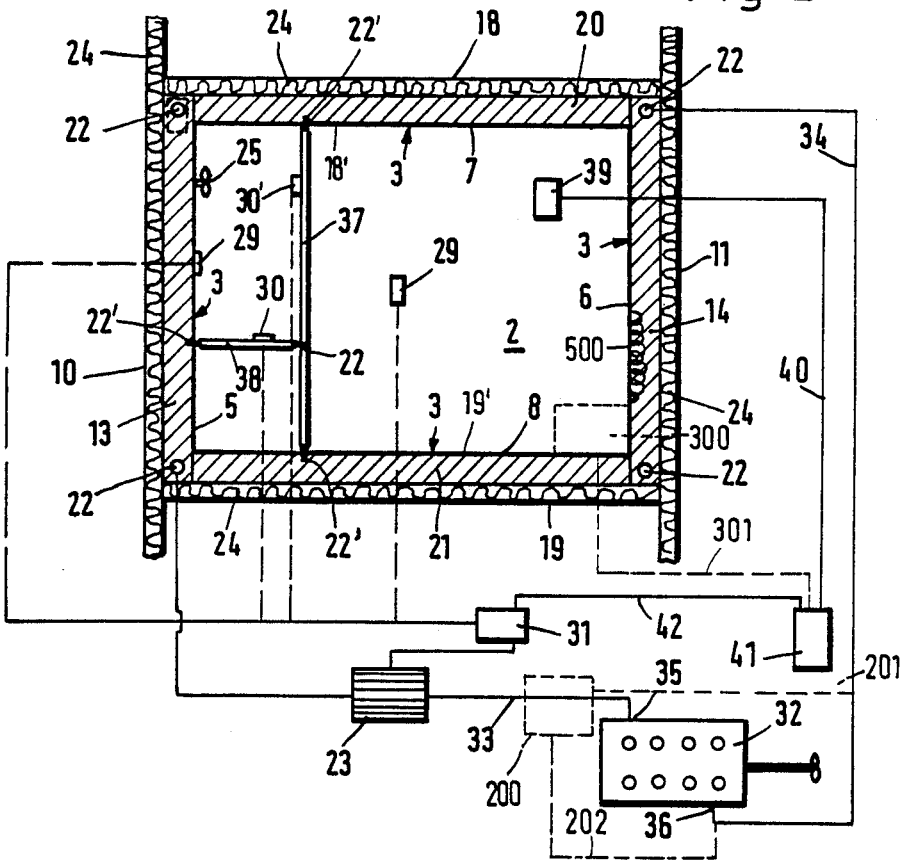

METHOD AND APPARATUS FOR SHIELDING CARGOES FROM CONDENSATE

This application is a continuation of application Ser. No. 610,326 filed May 15, 1984, now abandoned.

BACKGROUND OF THE INVENTION

The present invention relates to vessels, especially cargo vessels, in general and more particularly to improvements in methods and systems for shielding cargoes from condensate in the holds of seagoing vessels and similar conveyances.

Cargoes which are likely to spoil and/or to be otherwise affected by condensate in the cargo area of a seagoing vessel or the like are normally confined in sealed bags or other types of receptacles so as to prevent direct contact between the stowed material and condensate which is contained in the cargo area and is likely to deposit on the surrounding walls in response to changes of temperature. The simplest way of stowing many types of cargoes would be to pour or otherwise introduce the goods into the cargo area in unconfined state, i.e., into direct contact with the walls surrounding the space which is allotted for the storage of cargo. However, moisture in the air which fills the remainder of the storage area is likely to deposit on the surrounding walls and to trickle down into contact with the stored goods. This leads to spoilage and/or other problems. When the vessel travels from a warmer climate to a colder climate, the temperature in the cargo area is likely to sink so that the moisture in the air filling the space above and/or around the cargo condenses and deposits on the walls with the aforediscussed drawbacks as concerns the appearance and/or quality of the stored goods. The dew point can be reached rather rapidly if the difference between the temperature at the port of lading and the temperature in the selected sea lane is very pronounced.

It is well known that the temperature of walls surrounding the cargo area is likely to sink much more rapidly than the temperature of stowed cargo. The condensate which deposits on the surfaces of such walls gathers into droplets which trickle downwardly and contact the cargo or the receptacles for stored cargo. One presently known proposal to avoid condensation of moisture which is contained in the air in the cargo area includes ventilation of cargo area. This is effective only if the cargo is subdivided into batches which allow for the passage of circulating air therebetween and therearound. However, it is often desirable to store bulk cargo in the hold of a vessel without any partitioning, i.e., in the form of a coherent mass which fills the cargo area to a certain extent, the remainder of the area being filled with air which enters such area during admission of bulk cargo. Therefore, simple pouring of bulk cargo into the hold of a vessel is possible only if the cargo is not likely to spoil or to be otherwise adversely affected by condensed moisture. Consequently, the transport of a wide variety of goods is possible only by incurring the expense of introducing such goods into bags, sacks, containers or other types of receptacles which can effectively prevent direct contact between the goods and the condensate. A typical example of such goods is coffee which could be transported in bulk form at a fraction of the present cost but for the fact that it can be affected by condensate and, therefore, must be confined in relatively small receptacles in the form of bags. In addition, the bags must be stowed in the hold of a ship in such a way that there is enough room for circulation of air in order to reduce the likelihood of condensation of moisture along the walls and/or on the bags. All this contributes significantly to the cost of transport of goods which could be shipped at a fraction of the present cost if they could be simply poured into the cargo area without prior confinement in bags or similar relatively small receptacles. Storage in bags or the like also contributes to higher cost of evacuation of the contents of ships at the port of destination.

OBJECTS AND SUMMARY OF THE INVENTION

An object of the invention is to provide a novel and improved method of preventing spoilage of cargo which is sensitive to condensate but is nevertheless stored in the hold of a vessel in direct contact with the surrounding walls.

Another object of the invention is to provide a method which ensures reliable retention of moisture in the mass of air in the cargo area of a seagoing vessel or the like irrespective of the difference between the prevailing temperature at the port of loading and the temperature in the selected sea lane.

A further object of the invention is to provide a method which renders it possible to reliably transport all kinds of bulk and other goods at a fraction of the cost of presently known transport of goods which are likely to be damaged and/or otherwise adversely affected by condensate.

An additional object of the invention is to provide a novel and improved method of maintaining the temperature of air in the cargo area of a vessel or the like above the dew point.

Still another object of the invention is to provide a method which can be practiced in a number of different ways at a reasonable cost and with a high degree of reliability as concerns the avoidance of condensation of moisture in the mass of air which is confined in the cargo area.

A further object of the invention is to provide a novel and improved method of preventing fluctuations of temperature around the vessel from bringing about condensation of moisture in the mass of air which is entrapped in the cargo area of a vessel.

Another object of the invention is to provide a method which can be practiced in existing vessels for the transport of bulk goods or the like.

Still another object of the invention is to provide a novel and improved vessel wherein goods which are likely to spoil on contact with condensate are effectively shielded from condensate even if the mass of air in the cargo area contains a relatively high percentage of moisture.

An additional object of the invention is to equip the vessel with a novel and improved system for conditioning the cargo area.

A further object of the invention is to provide a vessel wherein the cargo can be protected from adverse or undesirable influence of condensate in a novel and improved way by the most reliable expedient of simply preventing condensation of moisture in the mass of air which is confined in the cargo area.

Still another object of the invention is to provide a vessel wherein the coolant for the engine or engines can be utilized in a novel and improved way.

Another object of the invention is to provide a system for preventing condensation of moisture in the mass of air which is entrapped in the cargo area of a seagoing vessel.

A further object of the invention is to provide a system which can be installed in existing vessels at a reasonable cost.

An additional object of the invention is to provide a system of the above outlined character which can be used with equal advantage in small or large vessels as well as in other types of conveyances which are designed to handle large quantities of cargo, particularly to transport cargo between remote locations so that they are likely to be contacted by air whose temperature fluctuates within a wide range which (in the absence of any undertakings to the contrary) is amply sufficient to render condensation of moisture in the mass of air in the cargo area not only likely but practically certain.

A further object of the invention is to provide a conditioning system which is highly versatile so that it can be used under most adverse as well as under highly favorable circumstances.

Another object of the invention is to provide a vessel conditioning system which occupies little room, whose operation can be automated to a desired extent and which renders it possible to transport, at a low cost, cargoes whose transport heretofore invariably necessitated resort to containers, bags and/or other types of receptacles.

One feature of the invention resides in the provision of a method of conditioning the cargo area of a vessel wherein the cargo (especially bulk cargo) is surrounded by walls which are in direct contact therewith as well as with moisture-containing air which is confined in the cargo area. The method comprises the steps of maintaining the temperatures of confined air as well as of the walls at values such as to prevent condensation of moisture on the walls and resulting contact between such condensed moisture and the cargo. The method can include regulating the moisture content of air in the cargo area so as to further reduce the likelihood of condensation of moisture on the walls.

The maintaining step can include maintaining the temperature of the walls, as well as the temperature of confined air, at an at least substantially constant value. Also, the maintaining step can include monitoring the temperature and the moisture content of air in the cargo area, utilizing the monitored values to ascertain the dew point of moisture in the air in the cargo area, and maintaining the temperature of air and the walls above such dew point.

The regulating operation can comprise reducing the moisture content of air in the cargo area.

The maintaining step can include heating the air in the cargo area by causing such air to exchange heat with the walls. The temperature of air in the cargo area can be monitored in one or more selected (strategic) zones of the cargo area and/or in the region or regions of one or more selected portions of the walls.

The maintaining step can comprise heating the air in the cargo area and/or the walls with heat which is generated by the engine or engines of the vessel. Such heating step can include establishing an exchange of heat between the engine or engines and a heat exchange medium, and establishing a transfer of heat between air in the cargo area and/or the walls on the one hand and the heat exchange medium on the other hand. For example, the heat transferrring step can include transferring heat from a liquid heat exchange medium to those sides of the walls which face away from the cargo area.

If the maintaining step includes contacting the walls with a heat exchange medium, such maintaining step can further comprise maintaining the temperature of the heat exchange medium at an at least substantially constant value. Still further, the maintaining step then includes (or can include) circulating the heat exchange medium while in contact with the walls.

As a rule, the walls will be contacted by a heat exchange medium whose temperature is above the dew point of moisture in the air which is confined in the cargo area. Such method then preferably involves monitoring of the temperatures of air and of the walls, and circulating the heat exchange medium at a rate which is a function of the monitored temperatures so as to thereby regulate the rate of delivery of heat to the walls and/or to the mass of confined air.

The maintaining step can further comprise directing a gaseous heat exchange medium against those sides of the walls which are contacted by cargo and air in the cargo area and effecting an exchange of heat between the gaseous heat exchange medium and the walls. Such method can further comprise circulating the heat exchange medium along and around the cargo in the cargo area. Still further, such method can comprise maintaining the temperature of the heat exchange medium above the dew point of moisture in the air which is confined in the cargo area. Still further, such method can comprise regulating the moisture content of the heat exchange medium.

Another feature of the invention resides in the provision of a vessel, such as a cargo ship, which comprises wall means defining at least one cargo-containing area which is arranged to be filled with cargo and moisture-containing air and wherein the cargo contacts the wall means, and regulating means for maintaining the temperature of the wall means and of the mass of air which is confined in the cargo area at values such as to prevent condensation of moisture on the wall means. Such vessel can include means for varying (e.g., reducing) the moisture content of air in the cargo area. Still further, the vessel can be equipped with means for monitoring the temperature of the wall means (such monitoring means can include sensor means in direct contact with the wall means), means for monitoring the temperature of air in the cargo area, and/or means for monitoring the moisture content of air in the cargo area. The means for monitoring the moisture content of air can be provided on the wall means.

The regulating means can comprise a source of heat exchange medium and means for effecting a transfer of heat between the heat exchange medium and air in the cargo area. For example, air in the cargo area can be heated through the medium of the wall means which, in turn, is heated by the heat exchange medium.

The wall means comprises top, bottom and side walls and the wall heating means can include means for heating at least one of these walls. The top wall can include or constitute a hatch cover and the regulating means can comprise means for circulating a heat exchange medium through the hatch cover. At least one wall of the wall means is preferably hollow and defines an internal compartment, and the regulating means can comprise means for circulating a heat exchange medium through such compartment or compartments. For example, the top wall can be provided with one or more compartments for circulation of a heat exchange medium therethrough. Analogously, the bottom wall can be hollow and the regulating means can include means for circulating a suitable heat exchange medium through the compartment or compartments of the bottom wall. Means (e.g., ribs, fins or the like) can be provided in the interior of wall means to promote the transfer of heat between the heat exchange medium in the compartment or compartments and the wall means.

It is also possible to install at least one heating coil in the wall means and to convey a suitable gaseous or liquid heat exchange medium through the coil. The wall means can include inner wall means contacting the cargo in the cargo area and outer wall means defining at least one compartment with the inner wall means; the heating coil is then preferably mounted in the compartment or compartments and on the inner wall means. Heat insulating means can be disposed in the compartment or compartments along the outer wall means.

The engine or engines of the vessel can heat one or more supplies of a suitable heat exchange medium (e.g., water or another coolant for the engine), and the regulating means can comprise suitable means for effecting a transfer of heat between such heat exchange medium and the wall means and/or air which is confined in the cargo area. The coolant itself can constitute the heat exchange medium which directly contacts the wall means; alternatively, the heated coolant can transfer heat to a second heat exchange medium which communicates the thus transmitted heat to the wall means. The heat exchange medium can be a gaseous or hydraulic fluid, e.g., air or water. If the heat exchange medium is a gas, the regulating means can comprise one or more nozzles installed in the wall means and serving to discharge the gaseous heat exchange medium into the cargo area. Such nozzle or nozzles can be mounted in or on the bottom wall and/or in or on the top wall of the wall means.

One or more fans can be provided to circulate the mass of air in the cargo area.

It is also possible to employ regulatng means in the form of or including one or more electrc heaters.

If the wall means defines several compartments, it is preferably formed with one or more passages connecting the neighboring compartments to each other so as to allow for circulation of a heat exchange medium in as well as between the compartments.

For example, if the top and side walls of the wall means are provided with discrete compartments, the compartment in the top wall can be connected with the compartment of each side wall by at least one passage allowing for circulation of heat exchange medium between the compartment of the top wall and the compartment or compartments of the side walls. The top wall is preferably separable from the adjacent side walls in the regions of the passages, and the vessel is preferably equipped with means for separably and sealingly securing each walls to each other.

The novel features which are considered as characteristic of the invention are set forth in particular in the appended claims. The improved system itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWINGS

FIG. 1 is a somewhat schematic transverse vertical sectional view of the hull of a cargo vessel which embodies the improved conditioning system; and FIG. 2 is a horizontal sectional view as seen in the direction of arrows from the line II—II of FIG. 1.

DESCRIPTION OF THE PREFERRED EMBODIMENTS

The drawing shows a vessel having a hull 1 which includes a wall structure 3 defining at least one cargo area or hold 2. The wall structure 3 completely surrounds the cargo area 2 and includes a bottom wall 4, two side walls 5, 6, a top wall 9, and two transverse walls 7 and 8. The side walls 5 and 6 extend in the longitudinal direction of the vessel. The illustrated top wall 9 constitutes or includes a hatch cover.

The wall structure 3 includes a set of inner walls which are shown by heavy lines and a set of outer walls which define with the adjacent inner walls discrete compartments indicated by hatching. FIG. 1 shows the outer walls 10, 11, 12, 16 which respectively form part of the side walls 5, 6, bottom wall 4 and top wall 9. The outer walls 18, 19 of the transverse walls 7, 8 are shown in FIG. 2. The compartments 13 and 14 are inwardly adjacent to the outer walls 10, 11, the compartment 15 is inwardly adjacent to the outer wall 12, the compartment 17 is inwardly adjacent to the outer wall 16, and the compartments 20, 21 are inwardly adjacent to the respective outer walls 18, 19. The inner walls are denoted by the same reference characters as the corresponding outer walls but each thereof is followed by a prime.

The drawing shows that each compartment extends along the full length and width of the corresponding inner and outer walls. The inner sides of such compartments are separated from the cargo area 2 by the outer sides 28 of the corresponding inner walls. The wall structure 3 further defines passages 22 which connect the neighboring compartments with each other. For example, and as shown in the upper portion of FIG. 1, the compartment 17 of the hollow top wall 9 communicates with each of the compartments 13, 14 in the hollow side walls 5 and 6 by at least one passage 22. This allows for circulation of a suitable heat exchange medium (which can be a gas or a liquid) not only in each of the compartments but also between neighboring compartments. One of the presently preferred heat exchange media is hot water. Such medium can constitute a coolant for the engine or engines 32 of the vessel which embodies the present invention. In other words, the heat exchange medium can perform a plurality of functions including cooling the engine or engines 32 as well as preventing condensation of moisture in the mass of air which is entrapped in the cargo area 2 at a level above the confined cargo and is in direct contact with the adjacent inner walls of the structure 3. FIG. 2 shows a supply conduit 33 receiving heated coolant from the outlet 35 of the cooling unit for the engine or engines 32 and such conduit means contains a suitable pump 23 which forces a stream of heated coolant into the compartments in the wall structure 3. FIG. 2 merely shows a single conduit 33 and a single pump 23 for delivery of heated coolant (liquid heat exchange medium) into the connecting passage 22 between the compartments 13 and 21. However, it is to be understood that the vessel can be provided with several supply conduits which can admit discrete streams of heated coolant to several compartments of the wall structure 3. FIG. 2 further shows a single return conduit 34 which receives spent heat exchange medium from the passage 22 between the compartments 14 and 20 to return such heat exchange medium (coolant whose temperature has been reduced as a result of heat transfer to the wall structure 3) into the inlet 36 of the cooling system for the engine or engines 32. The pump or pumps 23 ensure that the heat exchange medium is circulated not only in but also between the compartments of the wall structure 3 to thus effect a more satisfactory transfer of heat from such heat exchange medium to the inner and outer walls of the structure 3. Such circulation of the heat exchange medium further ensures that the conditioning of the inner and outer walls of the wall structure 3 is more uniform. The operation of the illustrated pump 23 is regulated by a control unit 31 which has an output connected with the motor for the pump 23 as well as an input for signals from a temperature monitoring device 29 in the form of a sensor attached to the inner side of the inner wall 10'. A second input of the control unit 31 is connected with the corresponding output of a computer 41 by a conductor 42. The computer 41 receives signals by way of a conductor 40 which is connected to a temperature monitoring device or sensor 39 installed in the cargo area 2 and serving to ascertain the temperature of the confined mass of air. A further sensor 29 can be installed in the cargo area 2 to transmit signals to the corresponding input of the control unit 31. Additional temperature monitoring devices 30 and 30' in the form of sensors can be installed within the confines of the wall structure 3, for example, on a transversely extending partition 38 and a longitudinally extending partition 37. Such partitions can be provided to subdivide the cargo area 2 into several smaller chambers, depending upon the quantity of bulk cargo which is to be transported in a particular chamber. The partitions 37 and 38 are preferably removable and/or shiftable so as to allow for the establishment of larger or smaller chambers. The operation of the control unit 31 is preferably such that the temperature of air in the cargo area 2 is at least substantially constant. The motor of the pump 23 is turned on or off as required to ensure that the temperature of air in the area 2 will remain constant during the entire voyage of the vessel.

It is assumed that a substantial part of the cargo area 2 is filled with bulk cargo which directly contacts the adjacent inner walls of the structure 3. It is also assumed that such cargo is sensitive to condensate, i.e., that condensate could affect the appearance and/or other characteristics of cargo in an undesirable way so that the moisture which is contained in the mass of air above the bulk cargo in the area 2 should be prevented from condensing at the inner sides of the inner walls of the structure 3. Some moisture-containing air invariably penetrates into the cargo area 2 during loading of cargo through the top portion of the wall structure 3. It will be readily appreciated that the moisture content of confined air can fluctuate within a very wide range. This depends on the climate in the port of lading, on the time of the year when the area 2 is being filled with cargo and on other factors. The temperature of cargo also depends on the temperature of the surrounding atmosphere in the port where the vessel is anchored to take on cargo. The hatch cover of the top wall 9, or the entire top wall 9, is placed on top of the side walls 5, 6 and transverse walls 7, 8 when the area 2 is filled with cargo to the desired or required extent. This seals or substantially seals the cargo area 2 from the surrounding atmosphere. If the loaded vessel takes a northerly route, it is highly likely that the temperature of water as well as the temperature of the surrounding air will be progressively lower, i.e., below the temperature at the port of lading. The differences between such temperatures can be very substantial, for example, when the vessel leaves a tropical port and takes a course toward a port in a northern state or country.

The outer walls of the structure 3 are subjected to the most pronounced cooling action. The wall structure 3 then tends to cool the air which is entrapped in the cargo area 2. In the absence of any measures to the contrary, this would lead to a reduction of the temperature of the mass of air in the cargo area to below the dew point of the moisture therein so that the moisture would condense on the inner sides of the inner walls of the wall structure 3. Such condensation is prevented by heating the wall structure 3 as well as the mass of air in the cargo area 2, preferably through the medium of the inner walls of the structure 3. As mentioned above, such heating is or can be effected by the circulating heat exchange medium which is supplied by the pump 23 and constitutes the supply of heated coolant which issues from the cooling system for the engine or engines 32 at the outlet 35 and is returned to such cooling system at the inlet 36. Condensation of moisture which is contained in the mass of air in the cargo area 2 can be prevented all the way along the non-covered portions of the inner sides of the inner walls of the structure 3 because the compartments between the inner and outer walls preferably extend all the way along the major portions of or the entire, inner and outer walls so as to enable the heat exchange medium to maintain the temperature of the inner walls, and hence the temperature of confined air, at values which invariably prevent condensation of moisture. The control unit 31 ensures that the pump 23 is operated for periods of time and at frequencies such that the circulating heat exchange medium reliably prevents condensation of moisture along the inner sides of the inner walls above the level of the stowed cargo in the area 2. The purpose of the temperature monitoring sensors 29, 30, 30' and 39 is to generate signals at strategic points in the interior of the wall structure 3 and along the inner sides of the inner walls so as to ensure that the control unit 31 can properly select the duration and frequency of operation of the motor for the pump 23.

The reference character 200 denotes in FIG. 2 a schematically shown heat exchanger which can be installed in the conduit 33 so as to receive heated coolant from the outlet 35 of the cooling system for the engine or engines 32. This heat exchanger then contains its own supply of a different heat exchange medium (for example, a gas) which is circulated by the pump 23 and/or by one or more additional pumps so as to flow through and between the compartments which are defined by the top, bottom, side, front and rear walls of the structure 3. In such modified construction, spent heat exchange medium is returned into the heat exchanger 200 by a line 201. The portion of the 34 between the line 201 and the inlet 36 of the cooling system for the engine or engines 32 is then omitted or sealed. A return conduit 202 is then provided to return spent coolant from the heat exchanger 200 to the inlet 36 of the cooling system for the engine or engines 32. As a rule, coolant which issues from the outlet 35 of the cooling system for the engine or engines 32 is sufficiently hot to be in a condition to exchange heat with air or another gas which is thereupon circulated through the compartments of the wall structure 3. As mentioned above, the heat exchange medium which is supplied by the pump or pumps 23 directly heats the wall structure 3 whereby the wall structure transmits heat to the mass of air which is confined in the cargo area 2. This prevents deposition of condensate along the inner sides of the inner walls of the structure 3.

The inner walls of the structure 3 can directly heat the cargo and the mass of air in the area 2. However, it is equally within the purview of the invention to set up one or more heating elements or aggregates in the cargo area 2 itself so that such aggregate or aggregates directly heat the confined mass of air as well as (if necessary) the confined bulk cargo. The aforediscussed partitions 37 and 38 can be said to constitute each heating elements because they receive heat from the inner walls of the structure 3 and transmit heat directly to air and cargo in the area 2.

The partitions 38 and 37 which are shown in FIG. 2 are hollow, and the improved conditioning system is provided with additional passages 22' which allow the heat exchange medium to flow between the compartments of the wall structure and the compartments of the hollow partitions 37 and 38. This converts the partitions 37 and 38 into discrete heating elements which are installed in the interior of the space 2 to transmit heat directly to the mass of moisture-containing air above the bulk cargo as well as to the bulk cargo itself.

As mentioned above, the output of the temperature monitoring sensor 39 in the cargo area 2 is connected with an inlet of the computer 41 by a conductor 40. This enables the computer 41 to evaluate the temperature and/or moisture content of air in the area 2 and to transmit appropriate signals to the control circuit 31 via conductor 42. The sensor 39 can comprise means for monitoring the temperature as well as the moisture content of air in the cargo area 2. The conductor 42 can constitute a two-way conductor which transmits signals from the computer 41 to the control unit 31 as well as in the opposite direction. In this manner, the computer 41 can receive signals which are generated by the sensors 29, 30 and 30'. Transmission of such signals to the computer 41 enables the latter to continuously ascertain the dew point of moisture in the mass of air which is confined in the cargo area 2 and to transmit appropriate signals to the control unit 31 for the motor of the pump 23. Moreover, the computer 41 can tramsmit signals to a suitable moisture withdrawing or admitting device which ensures that the moisture content of air in the cargo area 2 is maintained within an optimum range. The programming of the computer 41 is preferably such that the circulation of heat exchange medium through the compartments of the wall structure 3 and partitions 37, 38 suffices to maintain the temperature of the inner walls of the structure 3 and of the mass of air above the bulk cargo in the area 2 slightly above the dew point of moisture in such air. In other words, the selected mode of regulation can be such that the conditioning system which is shown in the drawing barely prevents condensation of moisture along the inner sides of the inner walls of the structure 3 and/or along the exposed surfaces of the partitions 37 and 38. Such mode of operation renders it possible to lower the temperature of air in the cargo area 2 below the temperature which prevailed in the area 2 during introduction of bulk cargo at the port of lading. Irrespective of the selected temperature of mass of air in the area 2, the prevailing conditions should be such that moisture which is contained in such air cannot deposit on the cargo and/or on the inner walls of the structure 3 and/or on the partitions 37, 38. In order to ensure more reliable monitoring of temperature and moisture content of air in the cargo area 2, the latter can contain two or more sensors 39 which are stragetically distributed within the confines of the wall structure 3 so as to reliably inform the computer 41 of the conditions prevailing in the cargo area 2. This enables the computer to properly control the unit 31 and the motor for the pump 23.

It is also possible to reduce the moisture content of air in the cargo area 2. The advantages of such mode of operation will be readily appreciated. Thus, if the air contains a lower percentage of moisture, the latter is much less likely to condense on the inner walls of the structure 3 and/or on the cargo in the area 2 and/or on the partitions 37, 38. The character 300 denotes a dehumidifier which is installed in the cargo area 2 and is operable in response to signals from the computer 41 via conductor means 301 so as to extract moisture if the moisture content of air in the area 2 is excessive. The dehumidifier 300 can be designed to return dehumidified air into the space within the confines of the inner walls of the structure 3.

When heating the mass of air in the cargo area 2, one should ensure that the temperature in each and every region of the area 2 will remain above the dew point of moisture in the confined mass of air. In other words, the exchange of heat between the inner walls of the structure 3 and the mass of air which is confined in the cargo area 2 should be such that the temperature of air is above the dew point not only in the regions which are immediately adjacent to such inner walls but also in that portion or those portions of the cargo area 2 which are remotest from the inner walls of the structure 3. The likelihood of unequal heating of air in the cargo area 2 by the inner walls of the structure 3 is rather pronounced because bulk cargo is normally a poor conductor of heat. Furthermore, the entrapped mass of air also constitutes a poor conductor of heat. Therefore, the temperature of inner walls of the structure 3 must be increased in such a way as to take into full consideration the thermal conductivity of bulk cargo and air in the cargo area 2. This is the function of the computer 41 and of sensors which are installed in the cargo area 2. It has been found that the installation of hollow partitions (such as the illustrated partitions 37, 38 in FIG. 2) contributes significantly to uniform distribution of heat in the mass of air which is confined in the area 2 above the mass of bulk cargo. If desired, the area 2 can contain more than two partitions which are distributed in such a way as to ensure more uniform heating of the entire mass of air above the body of bulk cargo.

If the system of FIGS. 1 and 2 employs a gaseous heat exchange medium which is circulated by one or more pumps 23 or analogous fluid flow machines through the compartments of the wall structure 3, the gaseous heat exchange medium can also be admitted directly into the cargo area 2 so as to directly exchange heat with the confined mass of air. An advantage of such mode of operation is that the dehumidifier 300 can be omitted because the gaseous heat exchange medium can alter the moisture content of air in the area 2 above the bulk cargo. If such admission of gaseous heat exchange medium into the area 2 is to take place, the gaseous heat exchange medium can be admitted through one or more nozzles 400 which are provided in the inner wall 16' of the top wall or hatch cover 9 and/or through one or more nozzles 400 which are provided in the inner wall 12' of the bottom wall 4 of the structure 3. Direct heating of air in the cargo area 2 by a gaseous heat exchange medium brings about the aforementioned advantage that the moisture content of entrapped air can be regulated without resorting to a discrete dehumidifier. However, a relatively dry or very dry gaseous carrier medium cannot be readily heated to an elevated temperature so that the heating of such heat exchange medium entails the consumption of substantial amounts of energy which may not be warranted under any and all circumstances. A satisfactory solution is that of using a first heat exchange medium to flow in and through the compartments of the wall structure 3 in order to heat the inner walls of such structure and to thereby indirectly heat the confined mass of air, as well as of using one or more nozzles 400 in order to discharge a hot gaseous carrier medium directly into the cargo area 2. Alternatively, one and the same gaseous carrier medium can be utilized for circulation in the compartments of the wall structure 3 as well as for admission into the cargo area 2 for directly contacting and influencing the temperature and moisture content of the confined mass of air. If the system employs one or more nozzles 400 for admission of a dry gaseous carrier medium into the cargo area 2, it is desirable or advisable to install in the area 2 one or more air circulating means such as a fan 25 which is schematically shown in the upper left-hand portions of FIGS. 1 and 2.

In order to avoid excessive losses of heat energy as a result of circulation of a liquid and/or gaseous heat exchange medium in the compartments of the wall structure 3, the system preferably further comprises layers 24 of suitable insulating means installed in the compartments of the wall structure 3 and preferably adjacent to the inner sides of the outer walls. Such insulating layer or layers 24 are preferably provided all the way around each and every compartment in the wall structure 3. It has been found that the provision of thermal insulating means greatly reduces the heat energy requirements of the conditioning system. Each of the illustrated insulating layers 24 preferably extends along the entire inner side of the respective outer wall.

In order to enhance the transfer of heat between the heat exchange medium which circulates in the compartments of the wall structure 3 and the inner walls of such structure, the outer sides 28 of the inner walls are preferably provided with ribs, fins or similar projections or protuberances 43 (see the left-hand portion of FIG. 1) which are surrounded by the body of circulating heat exchange medium and transfer heat to the adjacent inner walls of the structure 3. It is clear that similar heat transfer promoting devices can also be provided in the cargo area 2. This is shown schematically at 143 at the inner side of the inner wall 16' of the top wall 9 shown in FIG. 1. The ribs or fins 143 promote the exchange of heat between the wall structure 3 and the mass of air which is confined in the area 2 above the bulk cargo.

It is not always possible to avoid certain slight differences between the temperature of an inner wall and the temperature of the adjacent body of air in the cargo area 2. The purpose of the fan or fans 25 is to ensure more uniform distribution of heat in the entire mass of air above the bulk cargo in the area 2. The fan or fans 25 are preferably installed on one or both side walls and/or on the transverse wall or walls close to the top wall 9 of the structure 3. Continuous circulation or agitation of air in the cargo area 2 contributes to a substantial reduction of the likelihood of condensation of moisture along the inner sides of the inner walls of the structure 3.

As mentioned above, the nozzle or nozzles 400 can be provided not only in the top wall 9 but also in the inner wall 12' of the bottom wall 4. In other words, such nozzle or nozzles can discharge a gaseous heat exchange medium into bulk cargo which is confined in the area 2. It will be readily appreciated that the pressure of a gaseous carrier medium which is admitted to the nozzle or nozzles 400 in the inner wall 12' of the bottom wall 4 must be raised sufficiently to enable such carrier medium to penetrate through the bulk cargo and to mix with the mass of moisture-containing air above the upper surface of the cargo.

Referring again to FIG. 1, the lines 26 denote the surface where the top wall 9 abuts against the adjacent side walls 5, 6. Such surfaces are preferably provided in the regions of the respective connecting passages 26. The reference characters 27 denote locking devices for releasably securing the top wall 9 to the neighboring walls of the structure 3. The locking devices 27 are removed or loosened when the top wall 9 is to be removed or partially lifted so as to allow for introduction of cargo into or for evacuation of cargo from the area 2. The connections between the top wall 9 and the adjacent walls of the structure 3 are preferably airtight so as to prevent uncontrolled escape of air from the area 2 and/or uncontrolled admission of atmospheric air into such area. Moreover, such airtight sealing is desirable in order to prevent the escape of heat exchange medium from the compartment 17 in the interior of the top wall 9 and/or from the compartments which are in communication with the compartment 17. If the heat exchange medium is a liquid (normally water), it is evacuated from the compartment 17 before the top wall 9 is lifted to permit admission of cargo into or evacuation of cargo from the area 2.

It is further within the purview of the invention to replace the heat exchange medium in the compartments of the wall structure 3 with electric heating coils one of which is shown at 500. Such heating coils are preferably mounted at the outer sides 28 of the inner walls of the structure 3 and are connected with a suitable source of electrical energy to heat the inner walls in a controlled manner for the purpose of preventing condensation of moisture along the inner surfaces of the inner walls. Of course, the electric heating coils or coils 500 can be provided in addition to the compartments 13 etc., and the supply of heat exchange medium which is being circulated in and between such compartments. Still further, such electric heating coils can be replaced with heating coils in the form of tubes serving to circulate in their interior a heat exchange medium which thereby transfers heat to the inner walls of the structure 3. Combinations of the aforediscussed features are possible. All that counts is to ensure that moisture cannot condense along the inner walls of the structure 3. The provision of electric heating coils is desirable and advantageous when the temperature of coolant for the engine or engines 32 of the vessel does not suffice to ensure adequate heating of the wall structure 3 and of the mass of air in the cargo area 2. Furthermore, if the cooling system or systems for the engine or engines 32 cannot supply adequate amounts of heat energy, the vessel can be equipped with one or more additional water heaters for the heat exchange medium which is then supplied to the pump or pumps 23 for admission into the compartments of the wall structure 3. As mentioned above, if electrical heating elements are used, they are preferably mounted at the outer sides 28 of the inner walls of the structure 3. If the electrical heating elements are used exclusively (namely without resort to a gaseous or liquid heat exchange medium), they are preferably uniformly distributed along the entire outer sides 28 of the inner walls of the structure 3.

It is clear that the improved system is equally suited for properly conditioning air in a cargo area for goods which are confined in receptacles, such as bags, sacks, containers or the like. If the goods are stored in individual containers, it is desirable to provide a requisite number of fans 25 or a sufficiently large fan to ensure proper circulation of air around the containers in the area 2. It has been found that conditioning with hot air is particularly desirable and advantageous if the area 2 contains a number of discrete containers for bulk cargo or other types of cargo. In such instances, the gaseous heat exchange medium is preferably also admitted into the cargo area 2 by way of nozzles in the top wall 9, in the bottom wall 4 and/or in other walls of the structure 3.

An important advantage of the improved method and system is that the cost of transport of many types of bulk cargo and other types of cargo is reduced to a fraction of the present cost. This is due to the fact that cargo which is sensitive to condensate can be transported in direct contact with the walls surrounding the cargo area because the moisture in the air filling the remainder of such area cannot deposit on the walls and, consequently, cannot flow into direct contact with the confined cargo. It will be readily appreciated that the absence of the need for bags, containers and other types of receptables greatly reduces the cost of transporting cargo in seagoing vessels or analogous conveyances.

Another important advantage of the improved method and system is that the cost of properly conditioning the cargo area is relatively low or that such cost can be selected within a wide range without the danger of condensation along the inner surfaces of the walls surrounding the cargo area. Thus, the complexity of the improved system can be increased or reduced practically at will, as long as the system is capable of adequately heating the walls and the confined mass of air to a temperature which prevents condensation of moisture along the walls and direct contact between condensed moisture and the confined cargo. In accordance with a very simple and inexpensive embodiment of the improved system, the sensor or sensors within the confines of the wall structure 3 are distributed and designed to transmit signals which enable the pump or pumps 23 to circulate a heat exchange medium at a rate and for intervals such as to barely prevent condensation of moisture along the inner sides of the inner walls of the structure 3. This can be readily achieved if the temperature of air is maintained at a value which approximates or equals the temperature of confined cargo. The provision of the computer 41 or other suitable evaluating means, as well as of the control unit 31, contributes little to the overall cost of transport of bulk goods in seagoing vessels. In each and every instance, it is normally preferred to construct and assemble the improved system in such a way that the temperature of the mass of air above the cargo in the area 2 fluctuates relatively little or not at all. In other words, it is desirable to heat or cool the wall structure 3 in such a way that the temperature of the mass of air above the cargo in the area 2 will remain at least substantially constant.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of conditioning the cargo area of a shipping conveyance, particularly a watercraft, wherein the cargo area is surrounded by walls which serve to confine cargo, especially bulk cargo, as well as moisture-containing air, comprising the step of maintaining the temperature of confined air as well as the temperature of the walls at a value such as to prevent condensation of moisture on the walls, including externally heating the walls at least in regions where the walls are adjacent the confined cargo so that the cargo area is heated by heat which is transmitted by the walls.

2. The method of claim 1, comprising regulating the moisture content of air in the cargo area so as to further reduce the likelihood of condensation of moisture on the walls.

3. The method of claim 1, wherein said heating step comprises maintaining the temperature of the walls as well as the temperatue of air in the cargo area at an at least substantially constant value.

4. The method of claim 1, wherein said heating step comprises monitoring the temperature and the moisture content of air in the cargo area, utilizing the monitored values to ascertain the dew point of moisture in the air in the cargo area, and maintaining the temperatures of air in the cargo area and of the walls above such dew point.

5. The method of claim 1, comprising reducing the moisture content of air in the cargo area.

6. The method of claim 1, comprising monitoring the temperature of air in one or more selected zones of the cargo area.

7. The method of claim 1, comprising monitoring the temperature of air in the region or regions of one or more selected portions of the walls.

8. The method of claim 1, wherein said heating step comprises heating the walls with heat energy which is derived from an engine or engines of the conveyance.

9. The method of claim 1, wherein said heating step comprises transferring heat from a heat exchange medium to those sides of the walls which face away from the cargo area.

10. The method of claim 1, wherein said heating step comprises contacting the walls with a heat exchange medium and maintaining the temperature of the heat exchange medium at an at least substantially constant value.

11. The method of claim 10, comprising circulating the heat exchange medium.

12. The method of claim 1, wherein said heating step comprises contacting the walls with a heat exchange medium whose temperature is above the dew point of moisture in the air which is confined in the cargo area, monitoring the temperatures of such air and of the walls, and circulating the heat exchange medium at a rate which is a function of the monitored temperatures.

13. The method of claim 1, wherein said heating step comprises directing a gaseous heat exchange medium against those sides of the walls which face the cargo area and transferring heat from such gaseous heat exchange medium to the walls.

14. The method of claim 13, comprising circulating the gaseous heat exchange medium along and around cargo in said area.

15. The method of claim 13, comprising maintaining the temperature of the gaseous heat exchange medium above the dew point of moisture in the air which is confined in the cargo area.

16. The method of claim 13, comprising regulating the moisture content of the heat exchange medium.

17. In a shipping conveyance, particularly a watercraft, the combination of wall means defining at least one cargo area arranged to be filled with cargo and to confine moisture-containing air, said wall means including bottom, side and top walls; regulating means for maintaining the temperatures of said wall means and of air in the cargo area at values such as to prevent condensation of moisture on the wall means, including means for heating at least one wall of the wall means so that the cargo and the confined air are heated by said wall means; and means for varying the moisture content of air in said cargo area.

18. In a shipping conveyance, particularly a watercraft, the combination of wall means defining at least one cargo area arranged to be filled with cargo and to confine moisture-containing air, said wall means including bottom, side and top walls; regulating means for maintaining the temperatures of said wall means and of air in the cargo area at values such as to prevent condensation of moisture on the wall means, including means for heating at least one wall of the wall means so that the cargo and the confined air are heated by said wall means; and means for monitoring the temperature of said wall means.

19. In a shipping conveyance, particularly a watercraft, the combination of wall means defining at least one cargo area arranged to be filled with cargo and to confine moisture-containing air, said wall means including bottom, side and top walls; regulating means for maintaining the temperatures of said wall means and of air in the cargo area at values such as to prevent condensation of moisture on the wall means, including means for heating at least one wall of the wall means so that the cargo and the confined air are heated by said wall means; and means for monitoring the temperature of air in said cargo area.

20. In a shipping conveyance, particulary a watercraft, the combination of wall means defining at least one cargo area arranged to be filled with cargo and to confine moisture-containing air, said wall means including bottom, side and top walls; regulating means for maintaining the temperatures of said wall means and of air in the cargo area at values such as to prevent condensation of moisture on the wall means, including means for heating at least one wall of the wall means so that the cargo and the confined air are heated by said wall means; and means for monitoring the moisture content of air in said cargo area.

21. In a shipping conveyance, particularly a watercraft, the combination of wall means defining at least one cargo area arranged to be filled with cargo and to confine moisture-containing air, said wall means including a hollow bottom wall and side and top walls; and regulating means for maintaining the temperatures of said wall means and of air in the cargo area at values such as to prevent condensation of moisture of the wall means, including means for heating at least one wall of said wall means so that the cargo and the confined air are heated by said wall means, said heating means including means for circulating a heat exchange medium through said bottom wall.

22. In a shipping conveyance, particularly a watercraft, the combination of wall means defining at least one cargo area arranged to be filled with cargo and to confine moisture-containing air, said wall means including bottom, side and top walls and defining at least one internal compartment; regulating means for maintaining the temperatures of said wall means and of air in the cargo area at values such as to prevent condensation of moisture on the wall means, including means for heating at least one wall of the wall means so that the cargo and the confined air are heated by said wall means, said heating means including means for circulating a heat exchange medium through said compartment; and means for promoting the transfer of heat between said wall means and the medium in said compartment.

23. In a shipping conveyance, particularly a watercraft, the combination of wall means defining at least one cargo area arranged to be filled with cargo and to confine moisture-containing air, said wall means having inner wall means for contacting cargo and air in said area and outer wall means defining at least one compartment with said inner wall means, said wall means including bottom, side and top walls; heat insulating means disposed in said compartment and mounted on said outer wall means; and regulating means for maintaining the temperatures of said wall means and air in the cargo area at values such as to prevent condensation of moisture on the wall means, including means for heating at least one wall of said wall means so that the cargo and the confined air are heated by said wall means.

24. In a shipping conveyance, particularly a watercraft, the combination of wall means defining at least one cargo area arranged to be filled with cargo and to confine moisture-containing air, said wall means including bottom, side and top walls; at least one engine and a supply of coolant for said engine; and regulating means for maintaining the temperatures of said wall means and of air in the cargo area at values such as to prevent condensation of moisture on the wall means, including means for heating at least one wall of the wall means so that the cargo and the confined air are heated by said wall means, said heating means comprising a supply of gaseous heat exchange medium arranged to effect the transfer of heat between the coolant and said wall means in said area, and said heating means further comprising nozzle means installed in said bottom wall and arranged to discharge the gaseous heat exchange medium into said area.

25. In a shipping conveyance, particularly a watercraft, the combination of wall means defining at least one cargo area arranged to be filled with cargo and to confine moisture-containing air, said wall means including bottom, side and top walls; at least one engine and a supply of coolant for said engine; and regulating means for maintaining the temperatures of said wall means and of air in the cargo area at values such as to prevent condensation of moisture on the wall means, including means for heating at least one wall of the wall means so that the cargo and the confined air are heated by said wall means, said heating means comprising a supply of gaseous heat exchange medium arranged to effect the transfer of heat between the coolant and said wall means in said area, and said heating means further comprising nozzle means installed in said top wall and arranged to discharge the gaseous heat exchange medium into said area.

26. In a shipping conveyance, particularly a watercraft, the combination of wall means defining at least one cargo area arranged to be filled with cargo and to confine moisture-containing air, said wall means including bottom, side and top walls and defining a plurality of compartments and passages connecting said compartments with one another; and regulating means for maintaining the temperatures of said wall means and of air in the cargo area at values such as to prevent condensation of moisture on the wall means, including means for heating at least one wall of the wall means so that the cargo and the confined air are heated by said wall means, said heating means comprising means for circulating a heat exchange medium in and between said compartments.

27. The combination of claim 18, wherein said monitoring means includes sensor means in contact with said wall means.

28. The combination of claim 20, wherein said monitoring means is provided on or adjacent to said wall means.

29. The method of claim 1, wherein the shipping conveyance is a seagoing vessel.

30. The combination of claim 17, wherein the shipping conveyance is a seagoing vessel.

31. In a shipping conveyance, particularly a watercraft, the combination of wall means defining at least one cargo area arranged to be filled with cargo and to confine moisture-containing air, said wall means comprising a hatch cover; and regulating means for maintaining the temperatures of said wall means and of air in the cargo area at values such as to prevent condensation of moisture on the wall means, including means for heating the wall means in regions where the wall means contacts the cargo and the confined air so that the cargo and the confined air are heated by said wall means, said heating means including means for circulating a heat exchange medium through said hatch cover.

32. In a shipping conveyance, particularly a watercraft, the combination of wall means defining at least one cargo area arranged to be filled with cargo and to confine moisture-containing air, said wall means including at least one hollow wall defining an internal compartment; and regulating means for maintaining the temperatures of said wall means and of air in the cargo area at values such as to prevent condensation of moisture on the wall means, including means for heating the wall means in regions where the wall means contacts the cargo and the confined air so that the cargo and the confined air are heated by said wall means, said heating means including means for circulating a heat exchange medium through said compartment.

33. In a shipping conveyance, particularly a watercraft, the combination of wall means defining at least one cargo area arranged to be filled with cargo and to confine moisture-containing air; and regulating means for maintaining the temperatures of said wall means and of air in the cargo area at values such as to prevent condensation of moisture on the wall means, including means for heating the wall means in regions where the wall means contacts the cargo and the confined air so that the cargo and the confined air are heated by said wall means, said heating means including at least one heating coil installed in said wall means and means for conveying a heat exchange medium through said coil.

34. In a shipping conveyance, particularly a watercraft, the combination of wall means defining at least one cargo area arranged to be filled with cargo and to confine moisture-containing air, said wall means including a top wall having at least one internal compartment and a plurality of side walls adjacent to said top wall and each having at least one internal compartment, said wall means further having passages connecting the internal compartment of said top wall with the internal compartments of said side walls; and regulating means for maintaining the temperatures of said wall means and of air in the cargo area at values such as to prevent condensation of moisture on the wall means, including means for heating the wall means in regions where the wall means contacts the cargo and the confined air so that the cargo and the confined air are heated by said wall means, said heating means comprising means for circulating a heat exchange medium in and between said compartments.

35. The combination of claim 31, wherein said wall means includes at least one hollow wall defining an internal compartment and said heating means includes means for circulating a heat exchange medium through said compartment.

36. The combination of claim 31, wherein said wall means includes inner wall means for contacting cargo in said area and outer wall means defining at least one compartment with said inner wall means, said coil being installed in said compartment and being mounted on said inner wall means.

37. The combination of claim 14, further comprising at least one engine, said heating means including a supply of heat exchange medium receiving heat from the engine, and means for effecting a transfer of heat between said medium and said wall means.

38. The combination of claim 35, wherein the heat exchange medium is a coolant, particularly water, for said engine.

39. The combination of claim 14, further comprising at least one engine and a supply of coolant for said engine, said heating means comprising a supply of heat exchange medium arranged to effect the transfer of heat between the coolant and said wall means and/or air in said area.

40. The combination of claim 39, wherein the heat exchange medium is a gas.

41. The combination of claim 40, wherein said heating means further comprises nozzle means installed in said wall means and arranged to discharge the gaseous heat exchange medium into said area.

42. The combination of claim 14, comprising means for circulating the air in said area.

43. The combination of claim 14, wherein said heating means includes adjustable electric heater means.

44. The combination of claim 34, wherein said walls are separable from one another in the regions of said passages.

45. The combination of claim 34, further comprising means for separably connecting said walls to each other.

* * * * *